United States Patent [19]

Le Mer

[11] 4,426,010

[45] Jan. 17, 1984

[54] FILING DRUM FOR A COLUMN HAVING ROTARY DRUMS

[76] Inventor: Gérard Le Mer, 12 Chemin du Milieu, 95540 Mery sur Oise, France

[21] Appl. No.: 321,267

[22] Filed: Nov. 13, 1981

[30] Foreign Application Priority Data

Nov. 17, 1980 [FR] France ..... 80 24331

[51] Int. Cl.[3] ..... A47F 7/00

[52] U.S. Cl. ..... 211/163; 108/94; 211/144

[58] Field of Search ..... 211/40, 78, 144, 163; 108/94

[56] References Cited

U.S. PATENT DOCUMENTS

| | | | |
|---|---|---|---|
| 1,930,844 | 10/1933 | Ruddell | 211/144 X |
| 2,025,639 | 12/1935 | Bradford | 211/163 X |
| 2,526,245 | 10/1950 | Lathrop | 211/163 X |
| 2,690,843 | 10/1954 | Ament | 211/40 |
| 2,906,408 | 9/1959 | Motyka et al. | 211/40 |
| 3,170,741 | 2/1965 | Richards, Jr. | 211/40 X |
| 3,341,266 | 9/1967 | Schecter et al. | 211/40 X |
| 3,608,739 | 9/1971 | Duboff | 211/40 |
| 3,860,120 | 1/1975 | Victor | 211/144 X |
| 3,868,916 | 3/1975 | Ohlson | 211/163 |

*Primary Examiner*—Ramon S. Britts
*Assistant Examiner*—Peter A. Aschenbrenner
*Attorney, Agent, or Firm*—Kane, Dalsimer, Kane, Sullivan & Kurucz

[57] ABSTRACT

The drum constitutes an independent unit comprising two horizontal sheet steel circular platforms which are concentric with the axis of the column and spaced vertically apart. The lower platform is of large diameter and supports by their lower edge the files whose vertical edge opposed to the back of the files bears against a peripheral flange on the upper platform. The two platforms are rigidly assembled by radial struts whose end portions are fixed to the respective platforms and constitute separating elements defining compartments in each of which compartments a group of files may be filed.

14 Claims, 5 Drawing Figures

FILING DRUM FOR A COLUMN HAVING ROTARY DRUMS

DESCRIPTION

The present invention relates to a filing drum for a column having rotary drums, comprising a lower horizontal platform having a generally circular shape for supporting files or the like by their lower edge, these files being disposed vertically inside compartments in the shape of sectors defined by radial separating elements which are connected to the lower platform and to a bearing surface against which a vertical edge of the files is capable of bearing, and means for rotatively mounting the drum on the column.

As constructed at the present time, the drums of this type mostly comprise, as separating elements and as a bearing surface, solid sheet steel walls which are respectively planar and cylindrical, the assembly thereof being effected by a welding in the factory, both between the radial planar walls and the cylindrical support wall and between these walls and the lower platform. As a result of this arrangement, on one hand, the amount of material employed to construct the drum exceeds that which would be strictly necessary to ensure stiffness of the assembly and, on the other hand, the manufacture involves relatively costly tooling and a rather slow production rate. Moreover, the units produced have a large overall size which increases the transport costs.

An object of the invention is to overcome the aforementioned drawbacks and to provide a filing drum of the aforementioned type, wherein the separating elements are formed by struts whose ends are bolted or screwed respectively to the lower platform and to an upper platform which is coaxial with the lower platform and whose periphery forms the bearing surface for the files.

With this arrangement, the amount of the material required to construct a drum, which essentially comprises two platforms and an appropriate number of struts, preferably constituted by simple rods having bent and screw-threaded end portions, is reduced to a minimum. The platforms, if they are of sheet steel, may be produced at a high rate and cheaply by a press operation. As concerns the stuts, their production requires merely simple operations. The components of a drum may be transported within a small volume since the final assembly, achieved by screwing or bolting, is normally carried out on the site of utilization, possibly without the use of specialized labour.

The stability of the drum is on principle ensured by the struts which moreover have a separating function, but additional stiffening elements may be provided which interconnect the two platforms, these additional elements being, for example, in the form of vertical stays which are screwed or bolted by their ends to the respective platforms.

The upper platform of sheet steel preferably comprises on its periphery an abutment flange which is formed by a press operation and defines the bearing surface for the files and is traversed by the corresponding bent screwthreaded end portion of the rods forming the struts, this end portion being immobilized by a nut.

For the purpose of rotatably mounting the drum on the fixed column provided for this purpose, a ring forming a smooth bearing is inserted in a centre opening of each of the platforms, the lower platform being moreover adapted to bear against an element forming a thrust bearing which is constituted either by a horizontal flange of the bearing ring of the upper platform of a subjacent drum, or by a washer, or a thrust rolling bearing, provided at the upper end of a sleeve which constitutes the extreme lower part of the column, normally fixed to the centre of of a stand which supports the whole of the column.

The invention will be explained in a purely illustrative manner, in the ensuing description, which reference to the accompanying drawing in which.

Figure 1:
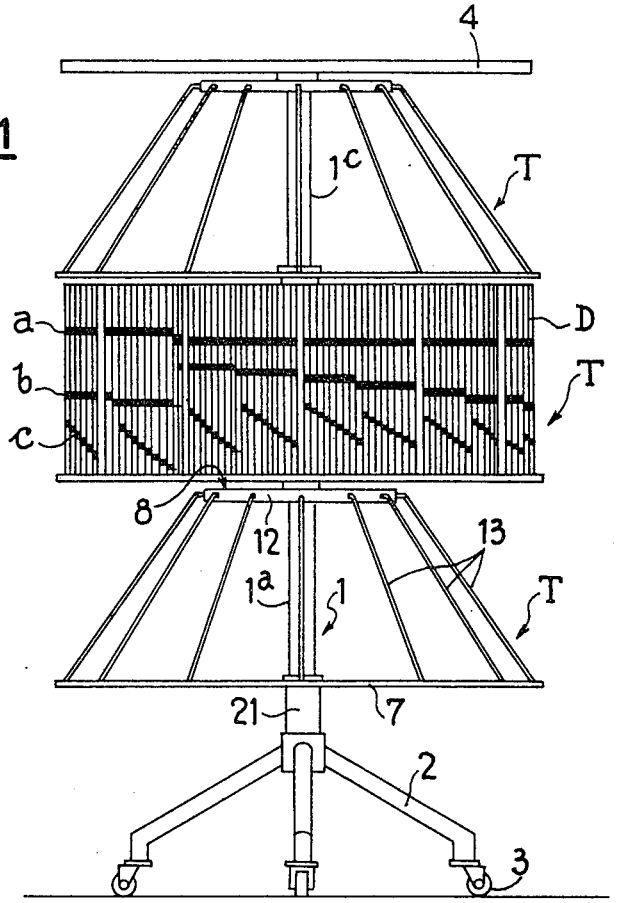
FIG. 1 is an elevational view of a column having three rotary filing drums bearing on the ground through a stand.
Figure 2:
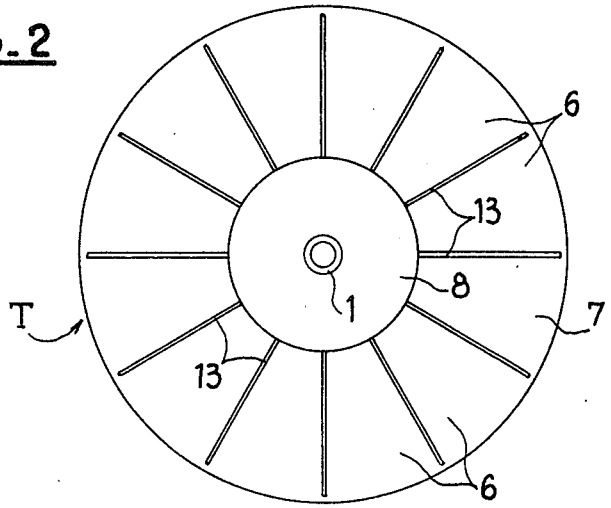
FIG. 2 is a plan view of a drum.

FIG. 1 shows three superimposed drums T which are rotatively mounted on a tubular column 1 whose lower end portion is secured to a cross-shaped stand 2 which bears on the ground through rollers 3. The upper end portion of the column is provided with a circular horizontal table 4 which acts as a protection and enables the files D filed in the compartments 6 to be consulted, these compartments being in the shape of a sector provided in each of the drums (FIG. 2).

Each drum T constitutes an independent unit comprising two horizontal circular platforms 7, 8 of sheet steel which are concentric to the axis of the column 1 and vertically spaced apart. The lower platform 7 of large diameter supports, by their lower edge, the files D whose vertical edge 9, opposed to the back 11, bears against a peripheral flange 12 on the upper platform 8 which consequently has a smaller diameter than the other platform. The two platforms 7, 8 are rigidly assembled by means of radial struts 13 constituted by solid cylindrical rods which are disposed obliquely and whose end portions 14, 16 are bent and screwthreaded so as to extend at a right angle respectively through the lower platform 7, in the vicinity of its folded flange 7*a*, and the abutment flange 12 of the upper platform 8, these end portions being immobilized by nuts 17.

Each of the platforms 7, 8 has a centre opening 18 in which is inserted a ring 19 constituting a smooth bearing which has a sliding contact with the outer surface of the cylindrical column 1, more precisely a section, such as 1*a* (FIG. 3), of this column which corresponds to the height of the drum T and is assembled by a screwed connection, at its lower end, with a sleeve 21 fixed at the centre of the stand 2 and at its upper end with an adjacent section 1*b* associated with the immediately upper drum T. For this purpose, the upper end portion 22 of the sleeve 21 and the end portion 23 of the tubular sections 1*a*, 1*b*, 1*c* (FIG. 1) are tapped and the lowerend portion 24 of each column section is provided with an end member 26 which is an interference fit therein and has a screwthreaded projecting portion 27 which is screwed into the associated tapped aperture.

Further, the upper end portion of the sleeve 21 and the end portion of each column section are provided with a thrust bearing which supports the lower platform 8 of the superjacent rotary drum. On the sleeve 21, this thrust bearing is formed by a smooth washer 28 which may be if required replaced by a ball bearing, whereas at the upper end of the sections 1*a*, 1*b*, 1*c* its is a smooth flange 29 of the bearing ring 19 which performs the function of a thrust bearing.

The rings 19 and the washer 28 are advantageously made from a plastics material having a low coefficient of friction such as Teflon.

The struts 13, which are circumferentially evenly spaced apart (FIG. 2), perform an assembling, stiffening and separating function, in that each space defined between two adjacent struts constitutes a compartment 6 for filing files, as illustrated in FIG. 1 which represents the centre drum provided with a compact group of files D. In the known manner, the back 11 of these files includes a filing grid defining gaps which may be selectively masked by means of self-adhesive strips in combination with numerical or alphabetic indices for the identification of the file. Thus the zones a, b, c, may designate respectively the hundreds, the tens and the units. Such an optical location permits immediately detecting any missing file or any error in the filing.

Figure 3:
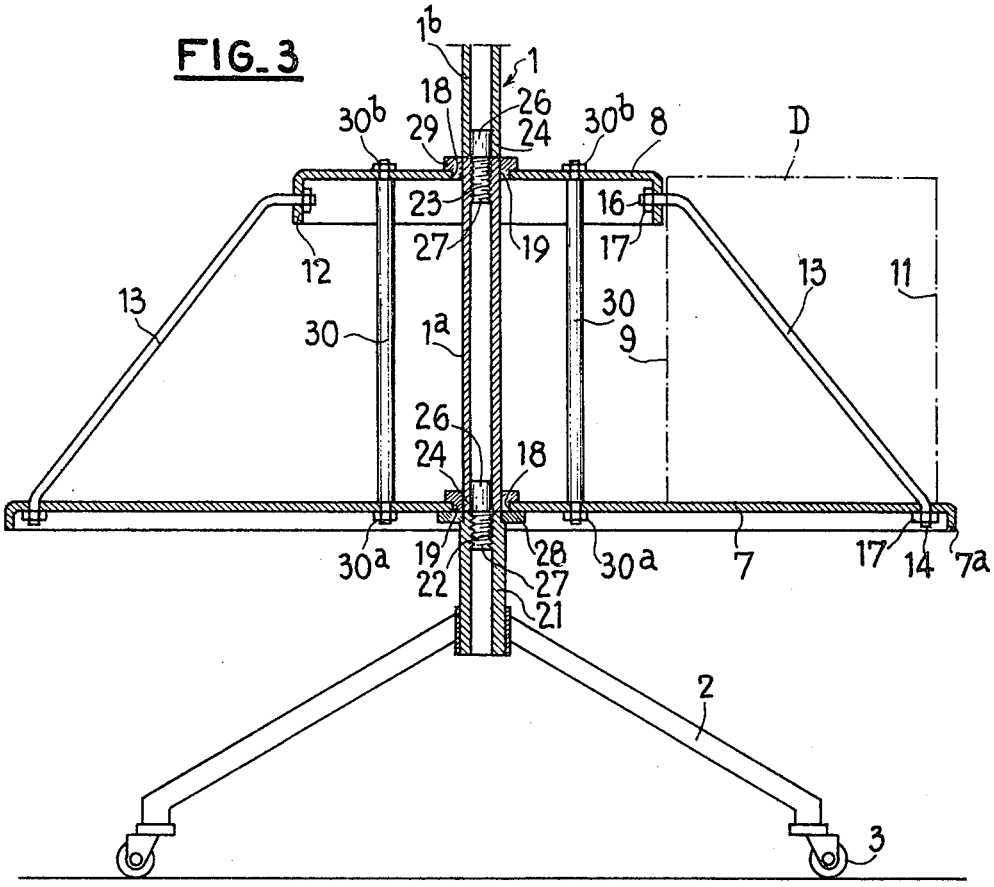
FIG. 3 is a partial vertical axial sectional view of the column of FIG. 1, to an enlarged scale, representing the lower drum and the support stand.

As can be in FIG. 3, complementary stiffening elements may be provided, which are for example formed by vertical stays 30, which are bolted at 30*a* and 30*b* to the platforms 7 and 8 respectively.

Figure 4:
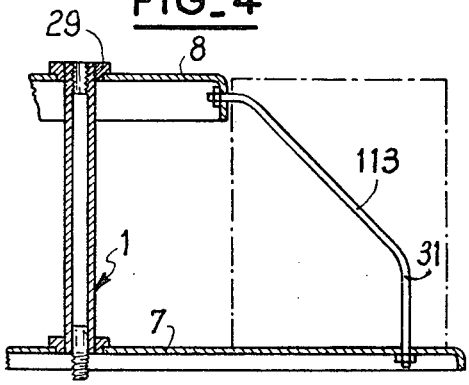
FIG. 4 is a partial axial vertical sectional view of a modification of the drum.

FIG. 4 shows that the struts may have a shape which is different from the rectilinear shape shown in FIGS. 1 to 3 and may for example be in the form of a rod 113 which is bent at an obtuse angle at 31.

In the illustrated embodiment, the separating rods 13 are twelve in number. It will be understood that this number may be reduced or increased in accordance with the intended use of the drum.

Figure 5:
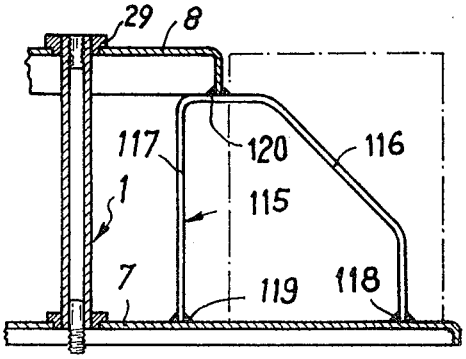
FIG. 5 is a partial axial vertical sectional view of another modification of the drum.

FIG. 5 shows that the struts may be welded to the platforms 7 and 8 instead of being bolted thereto. In the presently described embodiment, the struts and the vertical stays form arch-shaped elements 115 comprising an oblique portion 116 corresponding to a strut of the foregoing embodiments, and a vertical portion 117 corresponding to a stay of the other embodiments.

The arch-shaped element 115 is welded to the lower platform 7 by its two end portions 118 and 119 and to the upper platform in a bent region 120 which is in contact with the flange 112 of said platform.

Having now described my invention what I claim as new and desire to secure by Letters Patent is:

1. In a filing drum for a column having rotary drums, the drum comprising two coaxial vertically spaced horizontal platforms having a generally circular shape, radially extending obliquely disposed separating rods connected to the two platforms and defining compartments in the shape of sectors for receiving files, or like objects, which are disposed vertically and have a vertical edge which is capable of abutting the periphery of the upper platform which is of smaller diameter than the lower platform, and means for rotatably mounting the drum on the column; the improvement wherein the two platforms are of sheet metal, the upper platform comprises a peripheral flange which is press-formed on the upper platform and said separating rods constitute struts which have end portions and fixing means fix said end portions respectively to the lower platform and to said peripheral flange, which flange performs the function of an abutment for the files or like objects.

2. A drum according to claim 1, wherein said fixing means comprise screwing or bolting means.

3. A drum according to claim 1, wherein said fixing means comprise welding.

4. A drum according to claim 1, comprising complementary stiffening elements which interconnect the lower platform and upper platform, the stiffening elements comprising vertical stays and fixing means fixing the stays to the respective platforms.

5. A drum according to claim 4, wherein said fixing means comprise screwing or bolting means.

6. A drum according to claim 4, wherein said fixing means comprise welding.

7. A drum according to claim 1, wherein the struts are formed by a rectilinear rod whose end portions are bent and screwthreaded.

8. A drum according to claim 1, wherein an upper one of said end portions is bent and extends at a right angle through said peripheral flange of the upper platform.

9. A drum according to claim 4, wherein said struts and said stays are united in pairs and constitute arch-shaped elements comprising an oblique portion forming the strut and a vertical portion forming the stay, each arch-shaped element being welded to the lower platform at two ends of the arch-shaped element and welded to the upper platform in a bent region of the arch-shaped element.

10. A drum according to claim 1, 4, 7, 8 or 9, wherein each platform defines a centre circular opening and a ring is inserted in said centre opening, said ring constituting a bearing for surrounding the column in sliding contact with the column.

11. A drum according to claim 10, wherein said bearing ring of the upper platform includes a flange constituting a thrust bearing for the lower platform of a drum disposed on said column immediately above the drum.

12. A drum according to claim 10, wherein the two bearing rings are arranged to be in sliding contact around a tubular section of said column, said section having one end portion which is tapped and an opposite end portion which carries a screwthreaded end member which is capable of being screwed in the corresponding tapped end portion of an adjacent tubular section of said column.

13. A drum according to claim 11, wherein the two bearing rings are arranged to be in sliding contact around a tubular section of said column, said section having one end portion which is tapped and an opposite end portion which carries a screwthreaded end member which is capable of being screwed in the corresponding tapped end portion of an adjacent tubular section of said column.

14. A column in combination with filing drums which are rotatably mounted on said column in superimposed relation, said column comprising tubular sections, screwed connection means which assemble said sections, a cross-shaped stand, a vertical sleeve which is fixed to a centre part of the stand, said vertical sleeve having an upper end portion, screwed connection means which assemble the upper end portion of said vertical sleeve with a lower end portion of a tubular section of said tubular sections which corresponds to the lowermost drum of said drums, which lowermost drum bears on said upper end portion of said vertical sleeve with interposition of a thrust bearing, each of said drums comprising two coaxial vertically spaced horizontal platforms having a generally circular shape, radially extending obliquely disposed separating rods connected to the two platforms defining compartments in the shape of sectors for receiving files, or like objects, which are disposed vertically and have a vertical edge which is capable of abutting the periphery of the upper platform which is of smaller diameter than the lower platform, and means for rotatably mounting the drum on the corresponding tubular section of said column, wherein the two platforms are of sheet metal, the upper platform comprises a peripheral flange which is press-formed on the upper platform, and said separating rods constitute struts which have end portions, and fixing means fix said end portions respectively to the lower platform and to said peripheral flange, which flange performs the function of an abutment for the files or like objects.

* * * * *